US008864394B2

(12) United States Patent
Cofler

(10) Patent No.: US 8,864,394 B2
(45) Date of Patent: Oct. 21, 2014

(54) PRINTER SUBSTRATE EDGE TRIMMING

(75) Inventor: Marian Cofler, Kfar yona (IL)

(73) Assignee: Hewlett-Packard Industrial Printing Ltd., Netanya (IL)

( * ) Notice: Subject to any disclaimer, the term of this patent is extended or adjusted under 35 U.S.C. 154(b) by 215 days.

(21) Appl. No.: 13/335,317

(22) Filed: Dec. 22, 2011

(65) Prior Publication Data

US 2013/0164070 A1 Jun. 27, 2013

(51) Int. Cl.
*B41J 11/68* (2006.01)

(52) U.S. Cl.
USPC ..... 400/621.1; 400/621

(58) Field of Classification Search
CPC ..... B41J 11/68
USPC ..... 400/621.1; 83/14–16, 18; 399/384
See application file for complete search history.

(56) References Cited

U.S. PATENT DOCUMENTS

| | | | | |
|---|---|---|---|---|
| 2,738,729 | A | 3/1956 | Brooks | |
| 3,153,962 | A | 10/1964 | Jozsef et al. | |
| 3,964,356 | A | 6/1976 | Dineen | |
| 4,669,644 | A | 6/1987 | Nilsson | |
| 6,357,349 | B1 | 3/2002 | Tomberlin et al. | |
| 6,572,291 | B1 * | 6/2003 | Ho et al. | 400/621.1 |
| 6,934,507 | B2 * | 8/2005 | Ohki et al. | 399/406 |
| 7,240,595 | B2 * | 7/2007 | Kato et al. | 83/18 |
| 7,615,128 | B2 * | 11/2009 | Mikkelsen | 156/88 |
| 7,955,469 | B2 | 6/2011 | Broad et al. | |
| 2008/0193165 | A1 * | 8/2008 | Nakazawa et al. | 399/167 |

FOREIGN PATENT DOCUMENTS

| | | | | |
|---|---|---|---|---|
| DE | 3726538 | | 2/1989 | |
| GB | 681413 | | 10/1952 | |
| JP | 2004074544 | A * | 3/2004 | B41J 11/68 |

* cited by examiner

*Primary Examiner* — Ren Yan
*Assistant Examiner* — Justin Olamit

(57) ABSTRACT

According to one example of the present invention there is provided a printer for a printing on a roll of substrate. The printer comprises a substrate support for receiving a roll of substrate, a drive mechanism for driving substrate from a roll of substrate when installed on the substrate support through a print writing module, and a substrate edge trimming module for trimming the longitudinal edges of a substrate prior to the substrate passing through the print writing module.

16 Claims, 4 Drawing Sheets

PRINTER SUBSTRATE EDGE TRIMMING

BACKGROUND

In industrial printing systems it is common to print on rolls or webs of substrates. Use of webs facilitates high-speed and high volume printing.

In inkjet printing systems the printheads are contactless in that they do not come into direct contact with the substrate on which they are printing. A small gap, typically in the order of one or several millimeters, is maintained between the printheads and the substrate. Ink drops or other liquids are ejected from printhead nozzles across the gap to a substrate where they form part of a printed image. In the event that the size of the gap is not maintained during a printing operation damage may occur to the substrate causing print quality issues. In some situations a printhead may become irreplaceably damaged if it contacts a substrate.

Printing systems typically rely on being used with substrates conforming to a minimum set of manufacturer recommended characteristics. Characteristics may include, for example, the material of the substrate, the thickness of the substrate, the straightness of the substrate, and the like. Use of manufacturer recommended substrates helps ensure correct operation of the printing system, and further helps to reduce image quality problems.

There has recently, however, been a push by users to use cheaper substrates whose characteristics may not conform to manufacturer's substrate recommendations. Use of such substrates poses a real risk of image quality issues or printer damage occurring.

BRIEF DESCRIPTION

Examples, or embodiments, of the invention will now be described, by way of non-limiting example only, with reference to the accompanying drawings, in which.

Figure 4A:
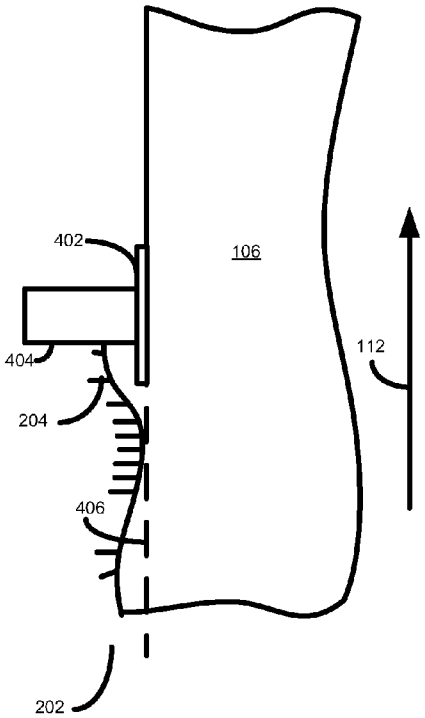
Figure 4B:
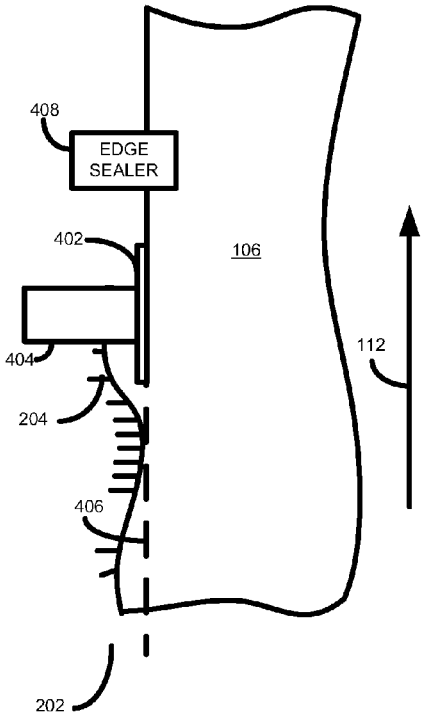
Figure 4C:
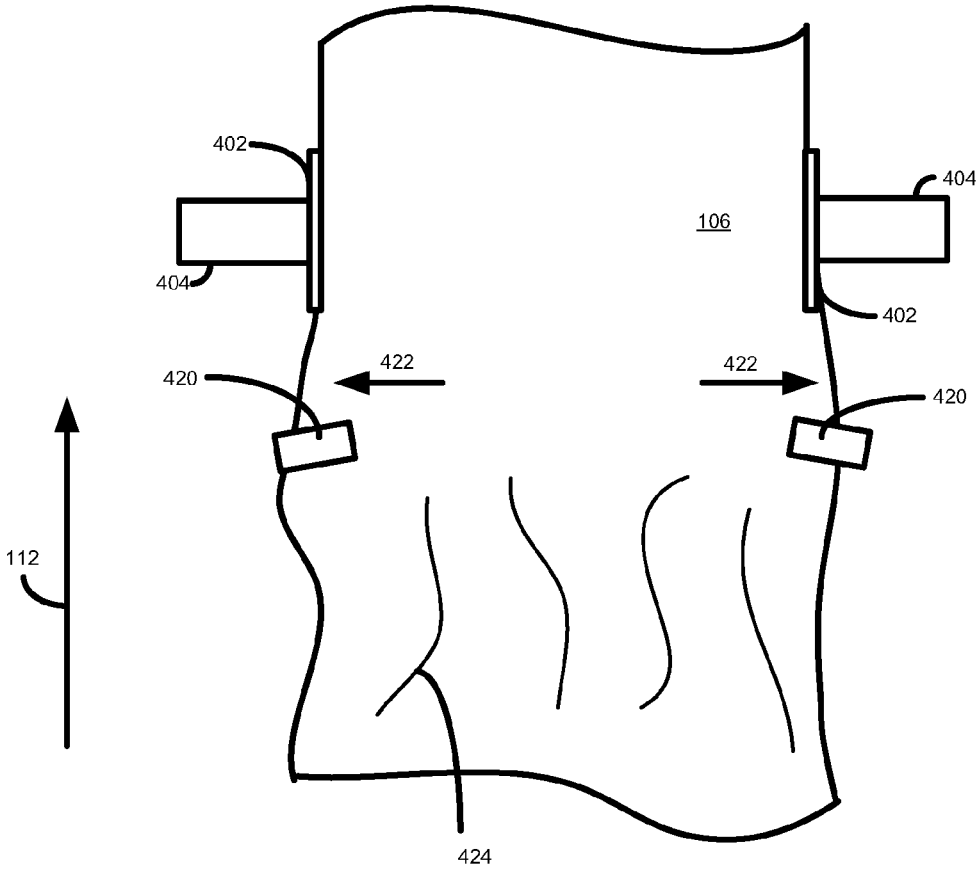
Figure 5:
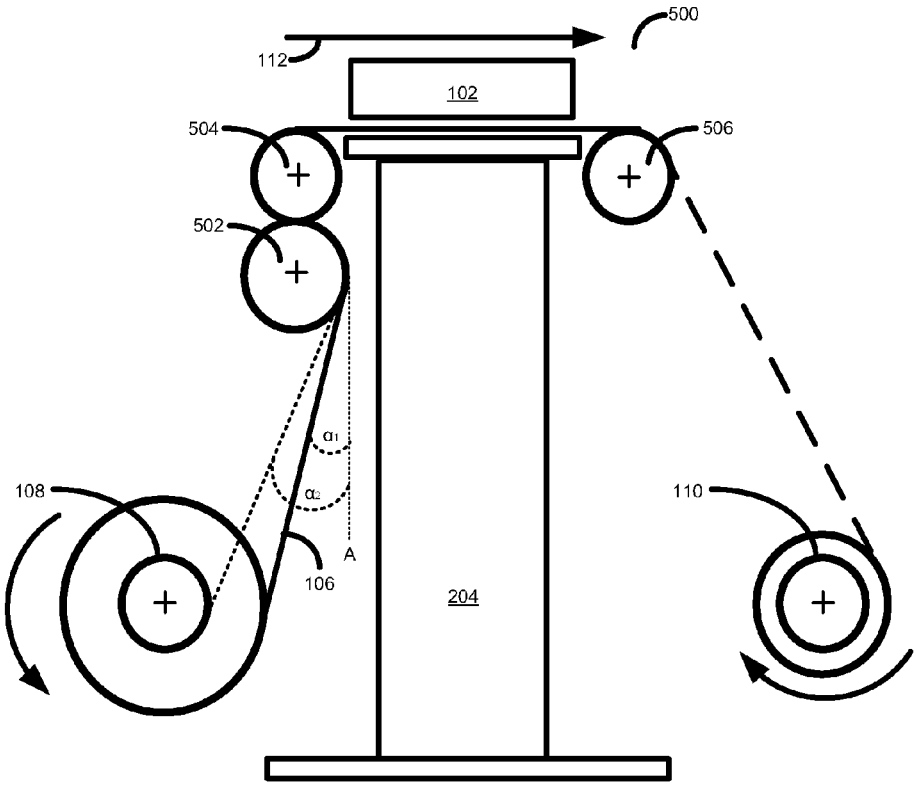
Figure 6:
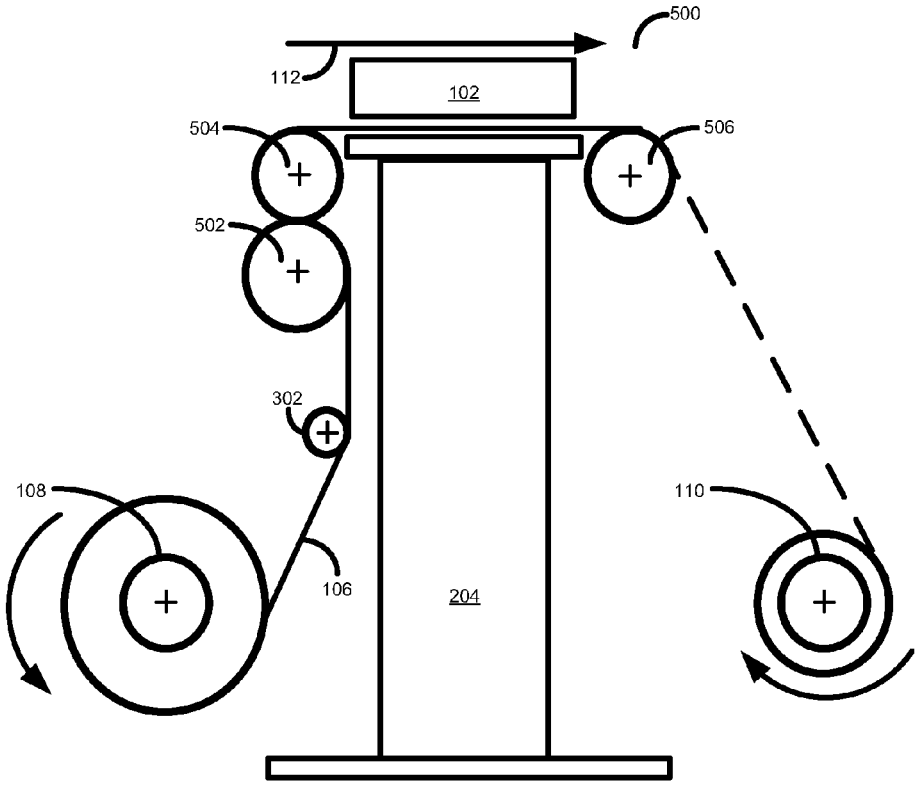

FIG. 4*a* is simplified illustration of an edge trimming module according to one example;

FIG. 4*b* is simplified illustration of an edge trimming module according to one example;

FIG. 4*c* is a simplified illustration of an edge trimming module according to one example;

FIG. 5 shows a simplified side view of a printing system 500 according to an example; and FIG. 6 shows a simplified side view of a printing system 500 according to an example.

DETAILED DESCRIPTION

Figure 1:
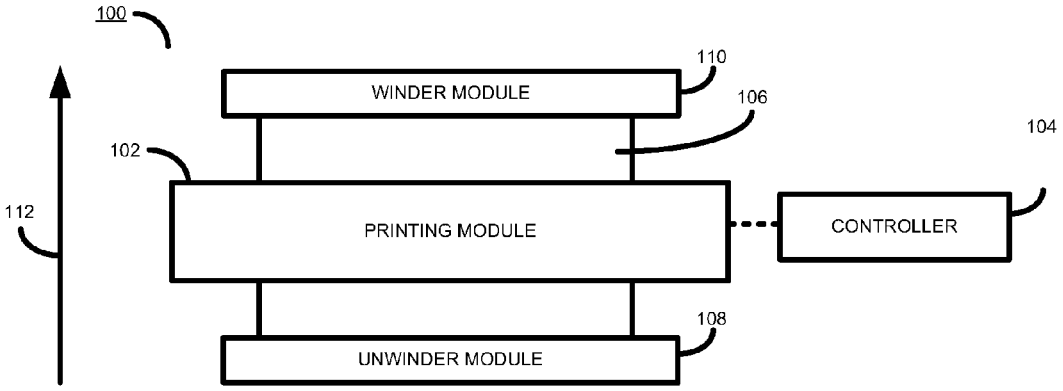
FIG. 1 is a simplified functional illustration of a printing system according to one example.

Referring now to FIG. 1 there is shown a simplified functional illustration of a printing system 100 according to one example of the present invention.

The printing system 100 comprises a printing module 102 that generates printed marks on a substrate 106, for example using a liquid ink, from one or multiple printheads or other ink mark making elements. In one example the printing module 102 comprises one or multiple inkjet printheads.

In the present example the substrate 106 is a web of substrate. The substrate 106 is wound on a roll and is installed in the printing system 100 in an unwind module 108 or other suitable substrate roll support mechanism. The substrate 106 is fed through the printing system 100 in a substrate path which leads the substrate 106 through the printing module 102 and onto a winder module 110. The winder module 110 drives the substrate 106 along the substrate path in the direction indicated by arrow 112. As substrate passes through the printing module 102 ink marks may be made on the substrate to form part of a printed image. Additional substrate drive mechanisms or modules (not shown), such as arrangements of powered rollers, may also be included in the substrate path to assist in moving the substrate through the printing system in a controlled manner.

The operation of the printing system 100, including the operation of the printing module 102 and the winder module is controlled by a controller 104.

Printing systems typically rely on being used with substrates conforming to a minimum set of manufacturer recommended characteristics. However, as users look to drive down costs, they are increasingly seeking to use cheaper, lower-quality substrates.

Figure 2:
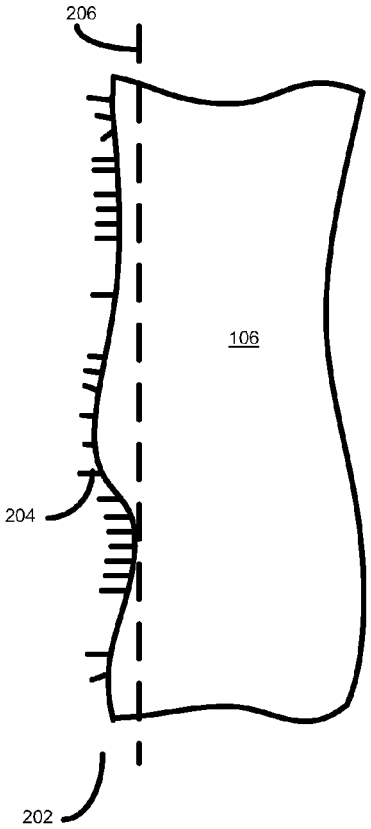
FIG. 2 is close-up view of a longitudinal edge portion of a substrate.

Low-quality substrates may exhibit characteristics that may not be in conformance with manufacturer's recommendations. For example, some low-quality substrates may have poorly-finished edges, as illustrated in FIG. 2. In FIG. 2 a close-up view of a longitudinal edge portion of a substrate 106 is shown. In the example shown, the edge 202 is poorly finished as substrate fibres 204 protrude from the edge. These protruding fibres may contact with an inkjet printhead during printing operating and may cause print-quality issues or may result in damage to printheads.

Furthermore, the edge 202 is irregular, and deviates from an ideal straight edge illustrated by line 206. Such an irregular edge may also cause problems within a printing system for a number of reasons. For example, many printing system use substrate edge detection sensors to determine the precise alignment of a substrate within the printing system, especially in the vicinity of the printing module 102. If the printing system determines that a substrate is not correctly aligned, the printing system may control the substrate path to realign the substrate laterally. This ensures that images printed by the printing module 102 are precisely aligned on a substrate. Consequently, if the substrate edges are not regular, the printing system may erroneously adjust the alignment of the substrate relative to the printing module 102.

Figure 3:
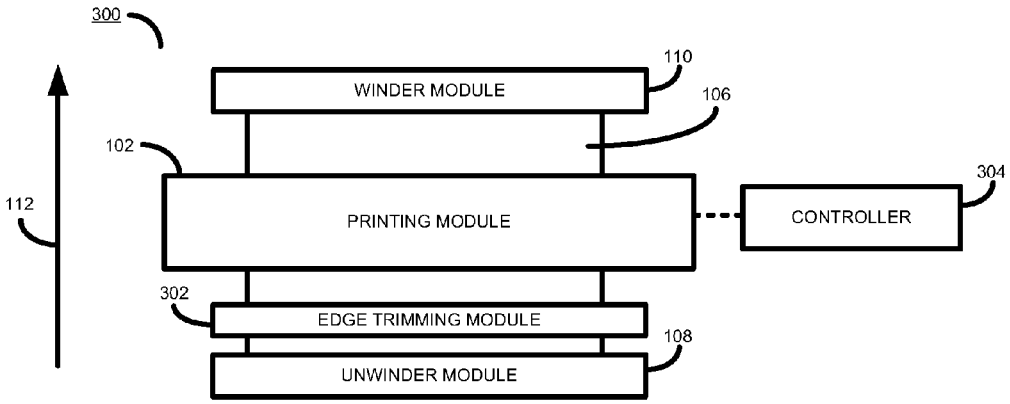
FIG. 3 is a simplified functional illustration of a printing system according to one example.

Referring now to FIG. 3 there is shown a simplified functional illustration of a printing system 300 according to an example of the present invention. The printing system 300 includes, in addition to the elements present in FIG. 1, an edge trimming module 302. The edge trimming module 302 is positioned in the substrate path between the unwind module 108 and the printing module 102, such that the edges of the substrate 106 are trimmed before the substrate passes through the printing module 102. This helps bring characteristics of the substrate into conformance with recommended substrate characteristics as defined by the manufacturer of the printing system 300.

In one example, as shown in FIG. 4*a*, the edge trimming module 302 comprises a rotary knife or cutter 402, mounted on a roller or axle 404, and is positioned at a predetermined trimming position 406 in the substrate path to trim the edges of the substrate 106 should they overlap the predetermined trimming position 406. In one example, the edge trimming module 302 may comprise other suitable substrate trimming elements, such as, for example, a laser cutter, a substrate knife, or the like. Any of the substrate 106 removed by the edge trimming module 302 may be removed and collected in a suitable collection area.

In a further example, as illustrated in FIG. 4*b*, the edge trimming module 302 additionally comprises an edge heat treatment element 408 for heat treating trimmed edges. The heat treatment element 408 may include, for example, a pair of heated rollers through which the edge of the trimmed substrate is passed, a hot air stream generator, an infrared lamp, a laser, or the like. Heat treating trimmed edges may be useful, for example, when the construction of the substrate is such that fibers may protrude from a trimmed edge. This may, for example, be the case when substrates made of PVC having an internal fibrous structure are used.

In one example the edge trimming module 302 comprises a pair of edge trimmers, each positionable towards each edge of the substrate such that both edges of the substrate are processed, as required, prior to the substrate entering the printing module. In one example the lateral position of at least one of the edge trimmers is adjustable to enable different width substrates to be processed thereby.

Once the substrate 106 has passed through the edge trimming module 302 the edges of the substrate 106 are substantially in conformance with the manufacturer's recommended substrate edge characteristics.

One of the advantages of positioning an edge trimming module in the printing system 100 before the substrate enters the printing module 102 is that it enables substrates that do not confirm to manufacturer specified minimum edge requirements to be used without causing image-quality issues, and without causing damage to the printing module 102 or other components of the printing system 100. For users of printing systems such a system may enable important cost savings to be obtained.

In a yet further example, as shown in FIG. 4*c* a substrate stretching mechanism is included in, or in addition to, the edge trimming module 302. In one example the substrate stretching mechanism includes lateral tensioning rollers 420 to laterally tension or stretch the substrate 106 in the direction 422 prior to the substrate passing through the edge trimming module 304. Each lateral tensioning roller 420 may comprise, for example, a pair of rollers forming a nip through which at least a margin portion of the substrate 106 passes. The lateral tensioning rollers 420 help remove wrinkles or creases 424 that may be present in the substrate 106, further improving conformance of the substrate 106 with the manufacturers recommended substrate characteristics.

Referring now to FIG. 5 there is shown a simplified side view of a printing system 500 according to an example.

The printing system 500 comprises a printing module 102 for creating ink marks on a substrate 106. The substrate 106 is a web of substrate wound on a roll and installed in an unwind module 108. The substrate 106 is fed through a pair of drive rollers 502 and 504 at which a nip is formed. At least one of the drive rollers 502 or 504 are powered. In conjunction with the powered winder module 110 a desired tension can be created in the substrate through a portion of the substrate path. The desired tension may help, for example, in assuring the flatness of the substrate 106 as it passes through the printing module 102.

As shown in FIG. 5, the angle at which the substrate 106 first contacts the drive roller 502 changes as the amount of substrate on the roll of substrate reduces. Thus, when the roll of substrate 108 has a first diameter the angle of entry is $\alpha_1$ (measured from the vertical plane A) and when the roll of substrate 108 has a second, smaller, diameter the angle of entry is $\alpha_2$. Similarly, some substrates may be wound differently from the other substrates and may require printing on a front or a rear side of the substrate. This may involve a roll of substrate being installed a different way around, which may also affect the angle of entry.

This change in angle as the substrate 106 unwinds from the roll of substrate 108 may cause a corresponding change in the level of friction between the substrate 106 and the drive roller 502. This change in the level of friction between the substrate and the driver roller changes the force needed to drive the substrate and may cause an increase in the amount of current drawn by roller drive motor. A change in the level of friction may also occur if a substrate has surface irregularities or has other mechanical properties that change along the length of a substrate. This may be particularly problematic in lower-quality substrates.

Changes in the level of friction may also cause substrate slippage or other substrate advance problems. This may occur, for example, since the nip pressure formed between the driver rollers 502 and 504 is typically maintained constant for any given substrate or thickness of substrate.

In a further example of the present invention, the edge trimming module 302 is positioned in the printing system 500 intermediate the unwind roller 108 and the drive rollers 502 and 504, such that the angle of entry of the substrate 106 to the driver roller 502 is constant, irrespective of the diameter of the roll of substrate on the unwind roller 108. In one example the angle of entry of the substrate 106 to the drive rollers 502 and 504 is between zero and 45 degrees from vertical. In other examples the angle of entry may be higher or lower depending on particular requirements or the arrangement of elements of the printing system.

In one example the edge trimming module 302 is provided as an aftermarket add-on to an existing printing system, to thereby enable existing printing systems to be used with low-quality substrates.

In other examples the edge trimming module 302 described herein may be adapted for use with sheets of substrate in place of a web of substrate.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A printer for a printing on a roll of substrate, the printer comprising:

a substrate support for receiving a roll of substrate;

a drive mechanism for driving substrate from the roll of substrate through a print writing module;

a substrate edge trimming module for trimming the longitudinal edges of the substrate prior to the substrate passing through the print writing module, wherein the substrate edge trimming module comprises:

a pair of edge trimming mechanisms, each edge trimming mechanism of the pair of edge trimming mechanisms being positioned to receive the longitudinal edges of the substrate, the longitudinal edges being opposite each edge of the substrate, the substrate edge trimming module being configured to trim the longitudinal edges in the direction of the transfer of the substrate through the print writing module; and an edge sealer module for applying heat to trimmed substrate edges.

2. The printer of claim 1, wherein the substrate edge trimming module comprises at least one of: a rotary knife, a rotary cutter, a substrate knife, or a laser substrate cutter.

3. The printer of claim 1, wherein the substrate edge trimming module comprises at least one of: a pair of heated rollers, a laser, a hot air stream generator, or an infra-red heat source.

4. The printer of claim 1, wherein the substrate edge trimming module further comprises a substrate tensioning mechanism to laterally tension a substrate prior to the edges of the substrate being trimmed.

5. The printer of claim 4, wherein the substrate tensioning mechanism includes lateral tensioning rollers configured to laterally tension the substrate.

6. The printer of claim 1, wherein the substrate edge trimming module is arranged intermediate a first roller and the drive mechanism such that the substrate from the roll of substrate installed on the substrate support enters the drive mechanism at a constant angle, wherein the first roller comprises an unwinding roller configured for holding a portion of the substrate in a rolled positioned and releasing, in response to the drive mechanism that is powered, in an unwinding motion an unwinding portion of the portion of the substrate, wherein the unwinding portion is moved in the direction of the print writing module.

7. The printer of claim 6, wherein an angle of entry of the substrate from the substrate edge trimming module to the drive mechanism is in the range of about 0 to 45 degrees from vertical.

8. A substrate edge trimming module for installation in a printing system, comprising:

a pair of edge trimmers, each edge trimmer of the pair of edge trimmers being configured to trim one longitudinal edge of longitudinal edges of a substrate when the substrate is present therein, the substrate edge trimming module configured to be installed in the printing system intermediate a printing system substrate support;

an edge sealer module comprising a pair of edge sealers, each edge sealer of the pair of edge sealers being positioned to receive a longitudinal edge of the longitudinal edges of the substrate, the longitudinal edges being opposite edges of the substrate, the pair of edge sealers being configured to apply heat to trimmed substrate edges in the direction of the transfer of the substrate through a print writing module; and a printing system drive mechanism that feeds the substrate through the printing system writing module.

9. The substrate edge trimming module of claim 8, further configured to be installed in a printing system such that substrate fed through the substrate edge trimming module enters the drive mechanism at a constant angle.

10. The substrate edge trim ling module of claim 9, further configured to be installed in a printing system such that substrate fed through the substrate edge trimming module enters the drive mechanism at a constant angle of about between 0 and 45 degrees from a vertical plane.

11. The substrate edge trimming module of claim 9, further comprising at least one of a rotary knife, a rotary cutter, a substrate knife, or a laser substrate cutter.

12. The substrate edge trimming module of claim 9, further comprising a substrate stretching mechanism to laterally stretch a substrate prior to the edges of the substrate being trimmed.

13. The substrate edge trimming module of claim 8, wherein the substrate edge trimming module comprises at least one of: a pair of heated rollers, a laser, a hot air stream generator, or an infra-red heat source.

14. A printer for printing on a roll of substrate, the printer comprising:

a substrate support for receiving a roll of substrate;

a drive mechanism for feeding substrate from the roll of substrate through a print writing module;

a substrate edge trimming mechanism for trimming the longitudinal edges of the substrate prior to the substrate passing through the print writing module, wherein the substrate edge trimming mechanism comprises:

a pair of edge trimming mechanisms, each edge trimming mechanism of the pair of edge trimming mechanisms being positioned to receive the longitudinal edges of the substrate, the longitudinal edges being opposite each edge of the substrate, the substrate edge trimming module being configured to trim the longitudinal edges in the direction of the transfer of the substrate through the print writing module, wherein the substrate edge trimming mechanism is arranged such that the substrate enters drive rollers of the print writing module with a constant angle; and an edge sealer module for applying heat to trimmed substrate edges.

15. The printer of claim 14, wherein the substrate edge trimming mechanism further comprises a substrate lateral stretching mechanism for laterally stretching the substrate prior to substrate edges being trimmed.

16. The printer of claim 15, wherein the substrate edge trimming mechanism is configured such that the constant angle is between about 0 and 45 degrees from a vertical plane.

* * * * *

UNITED STATES PATENT AND TRADEMARK OFFICE

CERTIFICATE OF CORRECTION

PATENT NO. : 8,864,394 B2
APPLICATION NO. : 13/335317
DATED : October 21, 2014
INVENTOR(S) : Marian Cofler It is certified that error appears in the above-identified patent and that said Letters Patent is hereby corrected as shown below:

Claims

In column 6, line 5, in Claim 10, delete “trim ling” and insert -- trimming --, therefor.

Signed and Sealed this
Fifth Day of April, 2016

Michelle K. Lee

Michelle K. Lee
*Director of the United States Patent and Trademark Office*